US005316598A

United States Patent [19]

Chang et al.

[11] Patent Number: 5,316,598

[45] Date of Patent: May 31, 1994

[54] SUPERPLASTICALLY FORMED PRODUCT FROM ROLLED MAGNESIUM BASE METAL ALLOY SHEET

[75] Inventors: Chin-Fong Chang, Morris Plains; Santosh K. Das, Randolph, both of N.J.

[73] Assignee: Allied-Signal Inc., Morristownship, Morris County, N.J.

[21] Appl. No.: 890,199

[22] Filed: May 29, 1992

Related U.S. Application Data

[60] Division of Ser. No. 732,012, Jul. 18, 1991, Pat. No. 5,129,960, which is a continuation-in-part of Ser. No. 586,179, Sep. 21, 1990, Pat. No. 5,078,807.

[51] Int. Cl.[5] ..... C22F 1/00; C22C 23/00

[52] U.S. Cl. ..... 148/420; 148/666; 420/405; 420/409

[58] Field of Search ..... 148/420, 666; 420/405, 420/409

[56] References Cited

U.S. PATENT DOCUMENTS

| | | | |
|---|---|---|---|
| 4,675,157 | 6/1987 | Das et al. | 420/405 |
| 4,765,954 | 8/1988 | Das et al. | 148/420 |
| 4,938,809 | 7/1990 | Das et al. | 148/406 |
| 5,078,807 | 1/1992 | Chang et al. | 148/420 |
| 5,129,960 | 7/1992 | Chang et al. | 148/420 |

OTHER PUBLICATIONS

Busk & Leontis, "The Extrusion of Powdered Magnesium Alloys", Trans. AIME, 188, Feb. (1950), 297-306.

Isserow & Rizzitano, "Microquenched Magnesium ZK60A Alloy", Int'l. J. of Powder Met. & Powder Tech., 10, No. 3, Jul. (1974) 217-227.

*Primary Examiner*—Upendra Roy

*Attorney, Agent, or Firm*—Ernest D. Buff; Gerhard H. Fuchs

[57] ABSTRACT

Magnesium base metal alloy sheet is produced by rolling the rolling stock extruded or forged from a billet at a temperature ranging from 200° C. to 300° C. The billet is consolidated from rapidly solidified magnesium based alloy powder that consists essentially of the formula $Mg_{bal}Al_aZn_bX_c$, wherein X is at least one element selected from the group consisting of manganese, cerium, neodymium, praseodymium, and yttrium, "a" ranges from about 0 to 15 atom percent, "b" ranges from about 0 to 4 atom percent, "c" ranges from about 0.2 to 3 atom percent, the balance being magnesium and incidental impurities, with the proviso that the sum of aluminum and zinc present ranges from about 2 to 15 atom percent. The alloy has a uniform microstructure comprised of fine grain size ranging from 0.2-1.0 μm together with precipitates of magnesium and aluminum containing intermetallic phases of a size less than 0.1 μm. The sheets have a good combination of mechanical strength and ductility and are suitable for military, space, aerospace and automotive application. The sheets can be superplastically formed at temperatures ranging from 275° C. to 300° C. and at strain rates ranging from $10^{-1}$ to $10^{-2}$. The condition which maximizes superplastic ductility is a temperature of 300° C. and a strain rate of 0.1/s. An elongation of 436%, combined with uniform deformation within the gage length, allows fabrication of complex shapes.

4 Claims, 7 Drawing Sheets

SUPERPLASTICALLY FORMED PRODUCT FROM ROLLED MAGNESIUM BASE METAL ALLOY SHEET

CROSS REFERENCE TO RELATED APPLICATIONS

This application is a division of Ser. No. 07/732,012 filed Jul. 18, 1991 now U.S. Pat. No. 5,129,960 which is a continuation in part of Ser. No. 07/586,179 filed Sep. 21, 1990 now U.S. Pat. No. 5,078,807.

FIELD OF THE INVENTION

This invention relates to a method of superplastic forming rolled sheet product of magnesium base metal alloy made by powder metallurgy/rapid solidification of the alloy.

DESCRIPTION OF THE PRIOR ART

Magnesium alloys are considered attractive candidates for structural use in aerospace and automotive industries because of their light weight, high strength to weight ratio, and high specific stiffness at both room and elevated temperatures.

The application of powder metallurgy/rapid solidification (PM/RS) processing in metallic systems results in the refinement of grain size and intermetallic particle size, extended solid solubility, and improved chemical homogeneity. By selecting the thermally stable intermetallic compound ($Mg_2Si$) to pin the grain boundary during consolidation, a significant improvement in the mechanical strength [0.2% yield strength (Y. S.) up to 393 MPa, ultimate tensile strength (UTS) up to 448 MPa, elongation (El.) up to 9%] can be achieved in PM/RS Mg-Al-Zn-Si alloys, [Das et al. U.S. Pat No. 4,675,157, High Strength Rapidly Solidified Magnesium Base Metal Alloys, June, 1987]. The addition of rare earth elements (Y, Nd, Pr, Ce) to Mg-Al-Zn alloys further improves corrosion resistance (11 mdd when immersed in 3% NaCl aqueous solution for $3.4\times10^5$ sec. at 27° C.) and mechanical properties (Y. S. up to 435 MPa, UTS up to 476 MPa, El. up to 14%) of magnesium alloys, [Das et al., U.S. Pat. No. 4,765,954, Rapidly Solidified High Strength Corrosion Resistant Magnesium Base Metal Alloys, August, 1988].

The alloys are subjected to rapid solidification processing by using a melt spin casting method wherein the liquid alloy is cooled at a rate of $10^5$ to $10^7$ °C./sec while being solidified into a ribbon. That process further comprises the provision of a means to protect the melt puddle from burning, excessive oxidation and physical disturbance by the air boundary layer carried with the moving substrate. The protection is provided by a shrouding apparatus which serves the dual purpose of containing a protective gas such as a mixture of air or $CO_2$ and $SF_6$, a reducing gas such as CO or an inert gas, around the nozzle while excluding extraneous wind currents which may disturb the melt puddle.

The as cast ribbon is typically 25 to 100 μm thick. The rapidly solidified ribbons are sufficiently brittle to permit them to be mechanically comminuted by conventional apparatus, such as a ball mill, knife mill, hammer mill, pulverizer, fluid energy mill. The comminuted powders are either vacuum hot pressed to about 95% dense cylindrical billets or directly canned to similar size. The billets or cans are then hot extruded to round or rectangular bars at an extrusion ratio ranging from 14:1 to 22:1.

Magnesium alloys, like other alloys with hexagonal crystal structures, are much more workable at elevated temperatures than at room temperature. The basic deformation mechanisms in magnesium at room temperature involve both slip on the basal planes along $\langle 1,1,-2,0\rangle$ directions and twinning in planes $\{1,0,-1,2\}$ and $\langle 1,0,-1,1\rangle$ directions. At higher temperatures (>225° C.), pyramidal slip $\{1,0,-1,1\}$ $\langle 1,1,-2,0\rangle$ becomes operative. The limited number of slip systems in the hcp magnesium presents plastic deformation conformity problems during working of a polycrystalline structure. This results in cracking unless substantial crystalline rotations of grain boundary deformations are able to occur. For the fabrication of magnesium alloy components, the temperature range between the minimum temperature to avoid cracking and a maximum temperature to avoid alloy softening is quite narrow.

Rolling of metals is one of the important metalworking processes. More than 90% of all the steel, aluminum, and copper produced go through the rolling process at least one time. Thus, rolled products represent a significant portion of the manufacturing economy and can be found in many sectors. The principal advantage of rolling lies in its ability to produce desired shapes from relatively large pieces of metals at very high speeds in a continuous manner. The primary objectives of the rolling process are to reduce the cross-section of the incoming material while improving its properties and to obtain the desired section at the exit from the rolls. The main variables which control the rolling process are (1) the roll diameter, (2) the deformation resistance of the metal, (3) the friction between the rolls and the metal, and (4) the presence of front tension and back tension. The friction between the roll and the metal surface is of great importance in rolling. Not only does the friction force pull the metal into the rolls, but it also affects the magnitude and distribution of the roll pressure. The minimum thickness sheet that can be rolled on a given mill is directly related to the coefficient of friction. By far the largest amount of rolled material falls under the general category of ferrous metals, including carbon and alloy steels, and stainless steels, and specialty steels. Nonferrous metals, including aluminum alloys, copper alloys, titanium alloys, and nickel-base alloys also are processed by rolling. Rolled magnesium alloy products include flat sheet and plate, coiled sheet, circles, tooling plate and tread plate. The commercially available rolled magnesium alloy sheets include AZ31B, HK31A, HM21A. AZ31B is a wrought magnesium-base alloy containing aluminum and zinc. This alloy is most widely used for sheet and plate and is available in several grades and tempers. It can be used at temperatures up to 100° C. Increased strength is obtained in the sheet form by strain hardening with a subsequent partial anneal (H24 and H26 temper). HK31A is a magnesium-base alloy containing thorium and zirconium. It has relatively high strength in the temperature up to 315° C. Increased strength is obtained in sheet by strain hardening with a subsequent partial anneal (H24 temper). HM21A is a magnesium-base alloy containing thorium and manganese. It is available in the form of sheet and plate usually in the solution heat-treated, cold-worked, and artificially aged (T8) and (T81) tempers. It has superior strength and creep resistance and can be used up to 345° C. Good formability is an important requirement for most sheet materials.

U.S. patent application Ser. No. 586,179, filed Sep. 21, 1990 to Chang et al. discloses a method for producing a sheet product of magnesium base metal alloy made by rapid solidification of the alloy, to achieve good mechanical properties. At room temperature, the sheet of the invention has a yield strength of 455 MPa (66 ksi) ultimate tensile strength of 483 MPa (70 ksi) and elongation of 5% along the rolling direction. As compared to the extrusion made from the same alloy, the sheet of the invention shows higher strength and lower ductility, due to the formation of strong (0001) texture developed during hot rolling.

Rolled magnesium alloy products can be worked by most conventional methods. For severe forming, sheet in the annealed (O temper) condition is preferred. However, sheet in the partially annealed (H24 temper) condition can be formed to a considerable extent. Because heat has significant effects on properties of hard-rolled magnesium, properties of the metal after exposure to elevated temperature must be considered in forming. Effects of multiple exposures at elevated temperature are cumulative. AZ31B-H24 sheet is commonly hot formed at temperatures below 160° C. (325° F.) to avoid alloy softening. Annealing is a function of both time and temperature of exposure. The maximum permissible combination of time and temperature that will ensure that the specified minimum room-temperature properties of AZ31B-H24, HK31A-H24, and HM21A-T8 can be retained is shown in Table 18, Metals Handbook, Vol. 2, 10th edition, 1990, p. 473.

References to metalworking of formed magnesium alloy parts made from rapidly solidified magnesium alloys are relatively rare. Busk et al. [Busk et al., "The Extrusion of Powdered Magnesium Alloys," *Trans. AIME.* 188 (2) (1950), pp. 297–306.] investigated hot extrusion of atomized powder of a number of commercial magnesium alloys in the temperature range of 316° C. (600° F.)–427° C. (800° F.). The as-extruded properties of alloys extruded from powder were not significantly different from the properties of extrusions from permanent mold billets.

In the study reported by Isserow et al. [Isserow et al., "Microquenched Magnesium ZK60A Alloy," *Int'l J. of Powder Met. and Powder Tech.*, 10, (3) (1974), pp. 217–227.] on commercial ZK60A magnesium alloy powder made by a rotating electrode process, extrusion temperatures varying from ambient to 371° C. (700° F.) were used. The mechanical properties of the room temperature extrusions were significantly better than those obtained by Busk et al., but those extruded at 121° C. (250° F.) did not show any significant difference between the conventionally processed and rapidly solidified material. However, care must be exercised in comparing their mechanical properties in the longitudinal direction from room temperature extrusions since they observed significant delamination on the fracture surfaces; and properties may be highly inferior in the transverse direction.

At high temperatures, above one-half of the melting point on the absolute temperature scale, extremely fine-grain aluminum, copper, magnesium, nickel, stainless steel, steel, titanium, zinc, and other alloys become superplastic. Superplasticity is characterized by extremely high elongation, ranging from several hundred to more than 1000%, but only at low strain rates (usually below about $10^{-2}$/S) at high temperatures. In general, superplastic materials also exhibit low resistance to plastic flow in specific temperature and strain rate regions. These characteristics of high plasticity and low strength are ideal for the manufacturer who needs to fabricate a material into a complex but sound body with a minimum expenditure of energy. However, the requirements of high temperatures and low forming rates have limited superplastic forming to low-volume production.

Three different types of superplasticity in terms of the microstructural mechanisms and deformation conditions, include micrograin superplasticity, transformation superplasticity, and internal stress superplasticity. For micrograin superplasticity, the high ductilities are observed only under certain conditions, and the basic requirements for this type of superplasticity are: (a) very fine grain size (of the order of 10 μm material); (b) relatively high temperature (greater than about one half the absolute melting point); (c) a controlled strain rate, usually 0.0001 to 0.01 /s. Because of stable grain size requirement for a superplastic metal, not all commercially available alloys are superplastic. In fact, very few such alloys are superplastic.

U.S. Pat. No. 4,938,809 to Das et al., entitled "Superplastic Forming Of Rapidly Solidified Magnesium Base Metal Alloys", discloses a method of superlastic forming of rapidly solidified magnesium base metal alloys extrusion to a complex part, to achieve a combination of good formability to complex net shapes and good mechanical properties of the articles. The forming rate ranges from about 0.00021 m/sec to 0.00001 m/sec. The forming temperature ranges from 160° C. to 240° C. Under this forming condition, the maximum elongation achieved on rapidly solidified magnesium alloy extrusion is about 200%. The superplastic forming allows deformation to near net shape. However, the requirements of low forming rates have limited superplastic forming of rapidly solidified magnesium alloy extrusions to low volume production. The lower ductility of rapidly solidified magnesium alloy sheet, as compared to extrusion due to the formation of strong (0001) texture developed during hot rolling, further increases the difficulty of superplastic forming of rapidly solidified magnesium alloy sheet.

There remains a need in the art for a method of superplastic forming magnesium alloy sheets rolled from rolling stock which has been extruded or forged from a billet consolidated from powders made by rapid solidification of the alloy.

SUMMARY OF THE INVENTION

The present invention provides a method of superplastic forming magnesium-base alloy sheet rolled from rolling stock extruded or forged from a billet consolidated from powders made by rapid solidification of the alloy. Generally stated, the alloy has a composition consisting essentially of the formula $Mg_{bal}Al_aZn_bX_c$, wherein X is at least one element selected from the group consisting of manganese, cerium, neodymium, praseodymium, and yttrium, "a" ranges from about 0 to 15 atom percent, "b" ranges from about 0 to 4 atom percent, "c" ranges from about 0.2 to 3 atom percent, the balance being magnesium and incidental impurities, with the proviso that the sum of aluminum and zinc present ranges from about 2 to 15 atom percent.

The magnesium alloys used in the present invention are subjected to rapid solidification processing by using a melt spin casting method wherein the liquid alloy is cooled at a rate of $10^5$ to $10^7$ °C./sec while being formed into a solid ribbon. That process further comprises the provision of a means to protect the melt puddle from burning, excessive oxidation and physical disturbance by the air boundary layer carried with the moving substrate. Said protection is provided by a shrouding apparatus which serves the dual purpose of containing a protective gas such as a mixture of air or $CO_2$ and $SF_6$, a reducing gas such as CO or an inert gas, around the nozzle while excluding extraneous wind currents which may disturb the melt puddle.

The alloy elements manganese, cerium, neodymium, praseodymium, and yttrium, upon rapid solidification processing, form a fine uniform dispersion of intermetallic phase such as $Mg_3Ce$, $Al_2(Nd, Zn)$, $M_3Pr$, $Al_2Y$, depending on the alloy composition. These finely dispersed intermetallic phases increase the strength of the alloy and help to maintain a fine grain size by pinning the grain boundaries during consolidation of the powder at elevated temperature. The addition of the alloying elements, such as: aluminum and zinc, contributes to strength via matrix solid solution strengthening and by formation of certain age hardening precipitates such as $M_{17}Al_{12}$ and MgZn.

The sheet of the present invention is produced from a rolling stock extruded or forged from a billet made by compacting powder particles of the magnesium-base alloy. The powder particles can be hot pressed by heating in a vacuum to a pressing temperature ranging from 150° C. to 275° C., which minimizes coarsening of the dispersed, intermetallic phases, to form a billet. The billet can be extruded or forged at temperatures ranging from 200° C. to 300° C. The extrusion ratio ranges from 12:1 to 20:1. The extrusion or forging has a grain size of 0.2–0.3 μm, dispersoid size of 0.01–0.04 μm. The extrusion or forging can be rolled to 0.5 mm (0.020") thick sheet at a temperature ranging from 200° C. to 300° C. Rolling is carried out at a rate ranging from 25 to 100 rpm. During rolling the roll gaps are adjusted to produce a thickness reduction of 2 to 25% per pass. The rolling process is repeated one or more times under the above conditions until the sheet thickness required is obtained. The sheet of the present invention has a strong (0001) texture, with subgrain size of 0.1–0.2 μm, dispersoid size of 0.02–0.04 μm, and network of dislocation.

The sheet of the present invention possesses good mechanical properties: high ultimate tensile strength (UTS) [up to 449 MPa (65 ksi)] and good ductility (i.e. >5 percent tensile elongation) along the rolling direction at room temperature. These properties are far superior to those of commercially available rolled magnesium sheets. The sheets are suitable for applications as structural components such as heat rejection fins, cover, clamshell doors, tail cone, skin in helicopters, rocket and missiles, spacecraft and air frames where good corrosion resistance in combination with high strength and ductility are important. As compared to the extrusion made from the same alloy, the sheet of the present invention shows higher strength and lower ductility, due to the formation of strong (0001) texture developed during hot rolling. However, the sheets can be superplastically formed at temperatures ranging from 275° C. to 300° C. and at strain rates ranging from 0.1 to 0.01. The condition which maximizes superplastic ductility is a temperature of 300° C. and a strain rate of 0.1/s. An elongation of 436% combined with uniform deformation within the gage length, allows fabrication of complex shapes.

BRIEF DESCRIPTION OF THE DRAWINGS

The invention will be more fully understood and further advantages will become apparent when reference is made to the following detailed description and the accompanying drawings, in which.

DETAILED DESCRIPTION OF THE INVENTION

Figure 1:
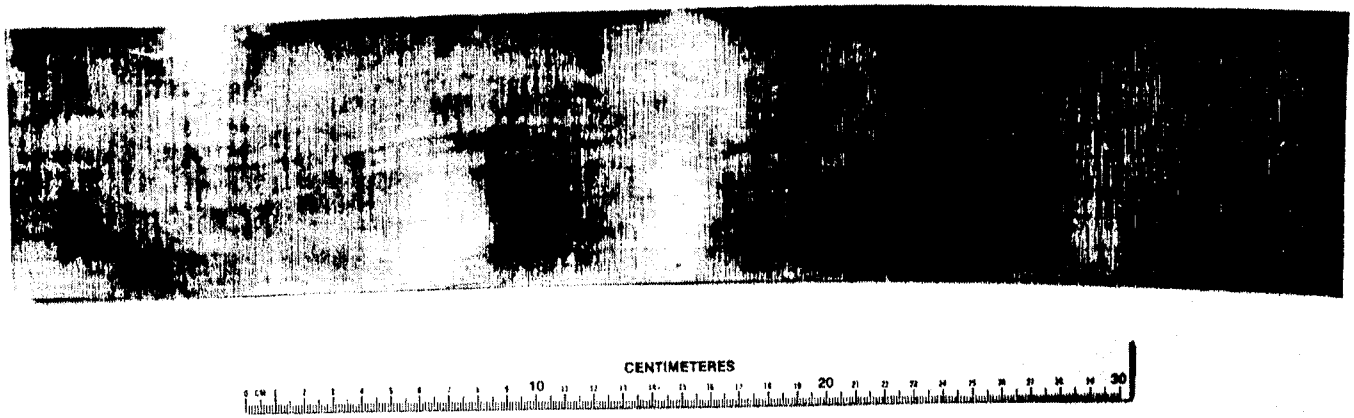
FIG. 1 is a macrograph of a 0.5 mm (0.02") thick rolled sheet of alloy $Mg_{92}Zn_2Al_5Nd_1$.

In accordance with the present invention a sheet is produced from a rolling stock extruded or forged from a billet consolidated from rapidly solidified alloy powders. The alloy consists essentially of nominally pure magnesium alloyed with about 0 to 15 atom percent aluminum, about 0 to 4 atom percent zinc, about 0.2 to 3 atom percent of at least one element selected from the group consisting of manganese, cerium, neodymium, praseodymium, and yttrium the balance being magnesium and incidental impurities, with the proviso that the sum of aluminum and zinc present ranges from about 2 to 15 atom percent. The alloy is melted in a protective environment; and quenched in a protective environment at a rate of at least about $10^{5}$° C./sec by directing the melt into contact with a rapidly moving chilled surface to form thereby a rapidly solidified ribbon. Such alloy ribbons have high strength and high hardness (i.e. microVickers hardness of about 125 kg/mm$^2$). When aluminum is alloyed without addition of zinc, the minimum aluminum content is preferably above about 6 atom percent.

The alloy has a uniform microstructure comprised of a fine grain size ranging from 0.2–1.0 μm together with precipitates of magnesium and aluminum containing intermetallic phases of a size less than 0.1 μm. The mechanical properties [e.g. 0.2% yield strength (YS) and ultimate tensile strength (UTS)] of the alloys of this invention are substantially improved when the precipitates of the intermetallic phases have an average size of less than 0.1 μm, and even more preferably an average size ranging from about 0.03 to 0.07 μm. The presence of intermetallic phases precipitates having an average size less than 0.1 μm pins the grain boundaries during consolidation of the powder at elevated temperature with the result that a fine grain size is substantially maintained during high temperature consolidation and secondary fabrication.

The as cast ribbon is typically 25 to 100 μm thick. The rapidly solidified materials of the above described compositions are sufficiently brittle to permit them to be mechanically comminuted by conventional apparatus, such as a ball mill, knife mill, hammer mill, pulverizer, fluid energy mill, or the like. Depending on the degree of pulverization to which the ribbons are subjected, different particle sizes are obtained. Usually the powder comprises of platelets having an average thickness of less than 100 μm. These platelets are characterized by irregular shapes resulting from fracture of the ribbon during comminution.

The powder can be consolidated into fully dense bulk parts by known techniques such as hot isostatic pressing, hot rolling, hot extrusion, hot forging, cold pressing followed by sintering, etc. Typically, the comminuted powders of the alloys of the present invention are vacuum hot pressed to cylindrical billets with diameters ranging from 50 mm to 279 mm and length ranging from 50 mm to 300 mm. The billets are preheated and extruded or forged at a temperature ranging from 160° to 240° C. at a rate ranging from 0.00021 m/sec to 0.00001 m/sec.

The microstructure obtained after consolidation depends upon the composition of the alloy and the consolidation conditions. Excessive times at high temperatures can cause the fine precipitates to coarsen beyond the optimal submicron size, leading to a deterioration of the properties, i.e. a decrease in hardness and strength. The alloys of the extrusion, from which the sheet of the invention rolled, have a very fine microstructure, which is not resolved by optical micrograph. Transmission electron micrograph reveals a uniform solid solution phase ranging from 0.2–1.0 μm in size, together with precipitates of very fine, binary or ternary intermetallic phases which are less than 0.1 μm and composed of magnesium, aluminum and other elements added in accordance with the invention. At room temperature (about 20° C.), the extrusion or forging of the invention has a Rockwell B hardness of at least about 55 and is more typically higher than 65. Additionally, the ultimate tensile strength of the extrusion or forging of the invention is at least about 378 MPa (55 ksi).

Samples cut from the extrusions can be rolled using conventional rolling mills, for example: two-high mill with 5" diameter steel rolls, at temperatures ranging from 200° C. to 300° C. with intermediate annealing at temperatures the same as roll temperature. The roll speed ranges from 25 rpm to 100 rpm. The reduction of thickness in the sample in each pass ranges from about 2 to 25%; and preferably from about 4 to 10%. The rolling process is repeated at least once and, typically, from 5 to 20 more times until the desired sheet thickness is achieved. At room temperature (about 20° C.), the sheet [0.4 mm (0.016") thickness] of the invention has a yield strength of 455 MPa (66 ksi), ultimate tensile strength of 483 MPa (70 ksi) and elongation of 5% along the rolling direction, which are superior to those of commercially available rolled magnesium alloy sheet. The sheet of the present invention has a strong (0001) texture, with subgrain size of 0.1–0.2 μm, dispersoid size of 0.02–0.04 μm, and network of dislocation. The sheets are suitable for applications as structural components such as heat rejection fins, cover, clamshell doors, tail cone, skin in helicopters, rocket and missiles, spacecraft and air frames where good corrosion resistance in combination with high strength and ductility is important.

As compared to the extrusion made from the same alloy, the sheet of the present invention shows higher strength and lower ductility, due to the formation of strong (0001) texture developed during hot rolling. However, the sheets can be superplastically formed at temperatures ranging from 275° C. to 300° C. and at strain rates ranging from $10^{-1}$ to $10^{-2}$. The condition which maximizes superplastic ductility is a temperature of 300° C. and a strain rate of 0.1/s. An elongation of 436%, combined with uniform deformation within the gage length would allow fabrication of complex shapes.

The following examples are presented in order to provide a more complete understanding of the invention. The specific techniques, conditions, materials and reported data set forth to illustrate the invention are exemplary and should not be construed as limiting the scope of the invention.

EXAMPLE 1

Ribbon samples were cast in accordance with the procedure described above by using an over pressure of argon or helium to force molten magnesium alloy through the nozzle onto a water cooled copper alloy wheel rotated to produce surface speeds of between about 900 m/min and 1500 m/min. Ribbons were 0.5–2.5 cm wide and varied from about 25 to 100 μm thick.

The nominal compositions of the alloys based on the charge weight added to the melt are summarized in Table 1 together with their as-cast hardness values. The hardness values are measured on the ribbon surface which is facing the chilled substrate; this surface being usually smoother than the other surface. The microhardness of these Mg-Al-Zn-X alloys of the present invention ranges from 140 to 200 kg/mm$^2$. The as-cast hardness increases as the rare earth content increases. The hardening effect of the various rare earth elements on Mg-Al-Zn-X alloys is comparable. For comparison, also listed in Table 1 is the hardness of a commercial corrosion resistant high purity magnesium AZ91D alloy. It can be seen that the hardness of the present invention is higher than commercial AZ91D alloy. The alloy has a uniform microstructure comprised of a fine grain size ranging from 0.2–1.0 μm together with precipitates of magnesium and aluminum containing intermetallic phases of a size less than 0.1 μm.

TABLE 1

Microhardness Values of R.S. Mg—Al—Zn—X As Cast Ribbons

| Sample | Composition Nominal (At %) | Hardness (kg/mm$^2$) |
|---|---|---|
| 1 | $Mg_{92.5}Zn_2Al_5Ce_{0.5}$ | 151 |
| 2 | $Mg_{92}Zn_2Al_5Ce_1$ | 186 |
| 3 | $Mg_{92.5}Zn_2Al_5Pr_{0.5}$ | 150 |
| 4 | $Mg_{91}Zn_2Al_5Y_2$ | 201 |
| 5 | $Mg_{88}Al_{11}Mn_1$ | 162 |
| 6 | $Mg_{88.5}Al_{11}Nd_{0.5}$ | 140 |
| 7 | $Mg_{92}Zn_2Al_5Nd_1$ | 183 |
| Alloy Outside the Scope of the Invention | | |
| Commercial Alloy AZ91D | | |
| 8 | $Mg_{91.7}Al_8Zn_{0.2}Mn_{0.1}$ | 116 |

EXAMPLE 2

Rapidly solidified ribbons were subjected first to knife milling and then to hammer milling to produce −40 mesh powders. The powders were vacuum outgassed and hot pressed at 200°–275° C. The compacts were extruded at temperatures of about 200°-300° C. at extrusion ratios ranging from 14:1 to 22:1. The compacts were soaked at the extrusion temperatures for about 20 mins. to 4 hrs. Tensile samples were machined from the extruded bulk compacted bars and tensile properties were measured in uniaxial tension at a strain rate of about $5.5\times10^{-4}$/sec at room temperature. The tensile properties together with Rocknell B ($R_B$) hardness measured at room temperature are summarized in Table 2. The alloys show high hardness ranging from 65 to about 81 $R_B$.

Most commercial magnesium alloys have a hardness of about 50 $R_B$. The density of the bulk compacted samples measured by conventional Archimedes technique is also listed in Table 2.

Both the yield strength (YS) and ultimate tensile strength (UTS) of the present alloys are exceptionally high. For example, the alloy $Mg_{91}Zn_2Al_5Y_2$ has a yield strength of 457 MPa (66.2 ksi) and UTS of 513 MPa (74.4 ksi) which is similar to that of conventional aluminum alloys such as 7075, and approaches the strength of some commercial low density aluminum-lithium alloys. The density of the magnesium alloys is only 1.93 g/c.c. as compared with the density of 2.75 g/c.c. for conventional aluminum alloys and 2.49 g/c.c. for some of the advanced low density aluminum-lithium alloys now being considered for aerospace applications. Thus, on a specific strength (strength/density) basis the magnesium-base alloys provide a distinct advantage in aerospace applications. In some of the alloys ductility is quite good and suitable for engineering applications. For example, $Mg_{91}Zn_2Al_5Y_2$ has a yield strength of 457 MPa (66.2 ksi), UTS of 513 MPa (74.4 ksi), and elongation of 5.0%, and $Mg_{92}Zn_2Al_5Nd_1$ has a yield strength of 436 MPa (63 ksi), UTS of 476 MPa (69 ksi), and elongation of 14%, which are superior to the commercial wrought alloy ZK60A, and casting alloy AZ91D, when combined strength and ductility is considered. The magnesium-base alloys find use in military applications such as sabots for armor piercing devices, and air frames where high strength is required.

TABLE 2

Room Temperature Properties of Rapidly Solidified Mg—Al—Zn—RE Alloys Extrusion

| Composition Nominal (AT %) | Dens. (g/c.c.) | Hard. ($R_B$) | Y.S. ksi (MPa) | U.T.S. ksi (MPa) | El. (%) |
|---|---|---|---|---|---|
| $Mg_{92.5}Zn_2Al_5Ce_{.5}$ | 1.89 | 66 | 52 (359) | 62 (425) | 17 |
| $Mg_{92}Zn_2Al_5Ce_1$ | 1.93 | 77 | 62 (425) | 71 (487) | 10 |
| $Mg_{92.5}Zn_2Al_5Pr_{.5}$ | 1.89 | 65 | 51 (352) | 62 (427) | 16 |

TABLE 2-continued

Room Temperature Properties of Rapidly Solidified Mg—Al—Zn—RE Alloys Extrusion

| Composition Nominal (AT %) | Dens. (g/c.c.) | Hard. ($R_B$) | Y.S. ksi (MPa) | U.T.S. ksi (MPa) | El. (%) |
|---|---|---|---|---|---|
| $Mg_{91}Zn_2Al_5Y_2$ | 1.93 | 81 | 66 (456) | 74 (513) | 5 |
| $Mg_{88}Al_{11}Mn_1$ | 1.81 | 66 | 54 (373) | 57 (391) | 4 |
| $Mg_{92}Zn_2Al_5Nd_1$ | 1.94 | 80 | 63 (436) | 69 (476) | 14 |
| Alloys Outside the Scope of the Invention | | | | | |
| Commercial Alloy | | | | | |
| ZK60A-T5 $Mg_{97.7}Zn_{2.1}Zr_{.2}$ | 1.83 | 50 | 44 (303) | 53 (365) | 11 |
| AZ91D $Mg_{91.7}Al_8Zn_{.2}Mn_{.1}$ | 1.83 | 50 | 19 (131) | 40 (276) | 5 |

EXAMPLE 3

Samples cut from the extrusions were cross rolled using two-high mill with 127 mm (5") diameter rolls at temperatures ranging from 200° C. to 300° C. with intermediate annealing at temperatures the same as roll temperature. The roll speed ranges from 25 rpm to 100 rpm. The reduction of thickness in the sample in each pass is about 0.254 mm (0.01"). FIG. 1 shows a macrograph of sheets of alloy $Mg_{92}Zn_2Al_5Nd_1$ with thickness of 0.508 mm (0.02"). Tensile samples were machined from the sheet and tensile properties were measured in uniaxial tension along the sheet rolling direction at a strain rate of about $5.5\times10^{-4}$/sec at room temperature. The tensile properties measured at room temperature along with their hardnesses are summarized in Table 3. At room temperature (about 20° C.), 0.4 mm (0.016") thick sheet of $Mg_{92}Zn_2Al_5Nd_1$ has a yield strength of 455 MPa (66 ksi), ultimate tensile strength of 483 MPa (70 ksi) and elongation of 5% along the rolling direction; 2.4 mm (0.095") thick sheet of $Mg_{92}Zn_2Al_5Nd_1$ has a yield strength of 490 MPa (71 ksi), ultimate tensile strength of 490 MPa (71 ksi) and elongation of 6%, which are superior to those of commercially available magnesium alloy sheet.

TABLE 3

Room Temperature Properties of Rapidly Solidified $Mg_{92}Zn_2Al_5Nd_1$ Alloy Sheets

| Sample No. | Thickness (in) | Rolling Temp. (°C.) | Hard kg/mm² | 0.2% Y.S. ksi (MPa) | U.T.S. ksi (MPa) | El. (%) |
|---|---|---|---|---|---|---|
| 1 | 0.025 | 200 | 144 | 73 (504) | 73 (504) | 0 |
| 2 | 0.020 | 250 | 163 | 73 (504) | 76 (538) | 4 |
| 3 | 0.016 | 285 | 155 | 66 (455) | 70 (483) | 5 |
| 4 | 0.014 | 285 | 155 | 57 (403) | 63 (435) | 6 |
| 5 | 0.015 | 300 | 152 | 54 (373) | 59 (407) | 5 |
| 6 | 0.075 | 250 | 157 | 51 (352) | 70 (483) | 4 |
| 7 | 0.095 | 250 | 148 | 71 (490) | 71 (490) | 6 |
| Commercially Avaliable Alloys | | | | | | |
| AZ31B-H2 4 | | | | 32 (220) | 42 (290) | 15 |
| HK31A-H2 4 | | | | 30 (205) | 38 (260) | 8 |
| HM21A-T8 | | | | 25 (170) | 34 (235) | 8 |
| M1A-H24 | | | | 26 (180) | 35 (240) | 7 |

EXAMPLE 4

Figure 2A:
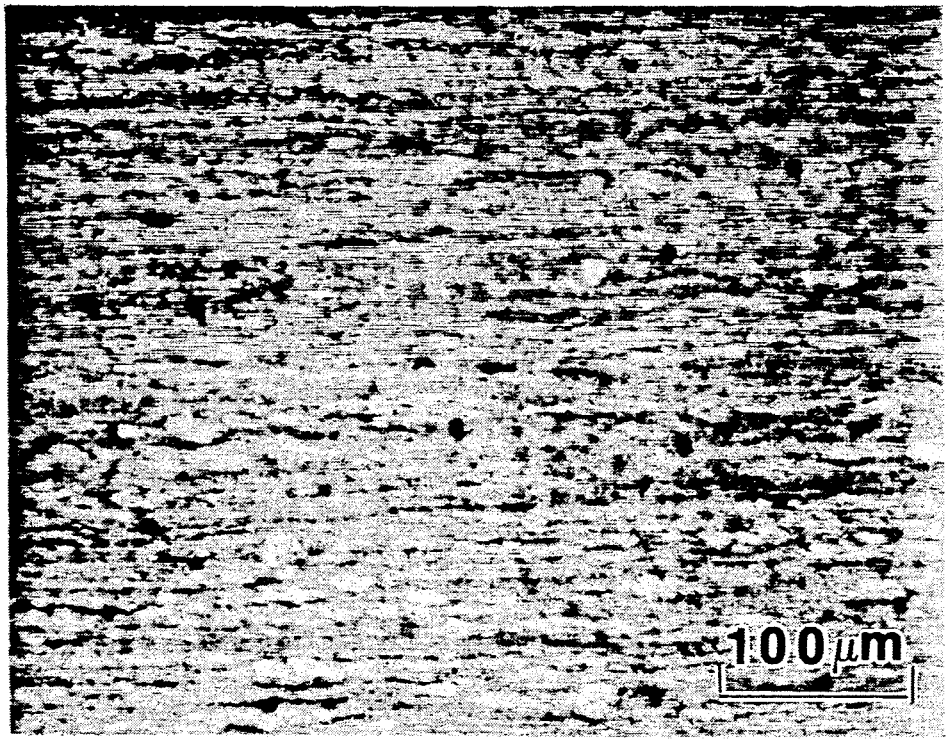
FIG. 2*a* and FIG. 2*b* are optical micrographs of rolled sheet of alloy $Mg_{92}Zn_2Al_5Nd_1$ at a low and high magnification.
Figure 2B:
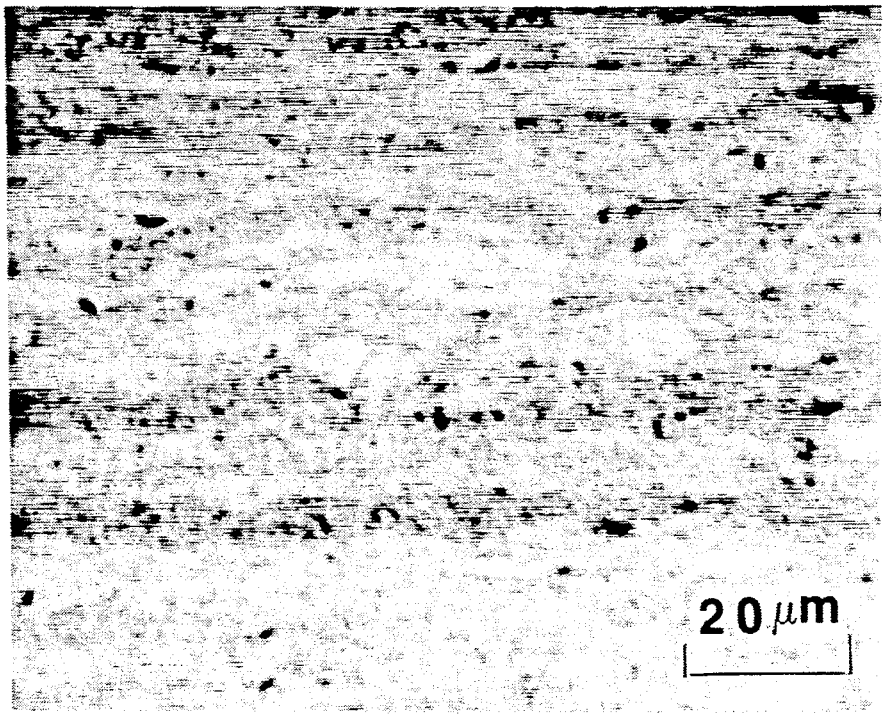
Figure 3:
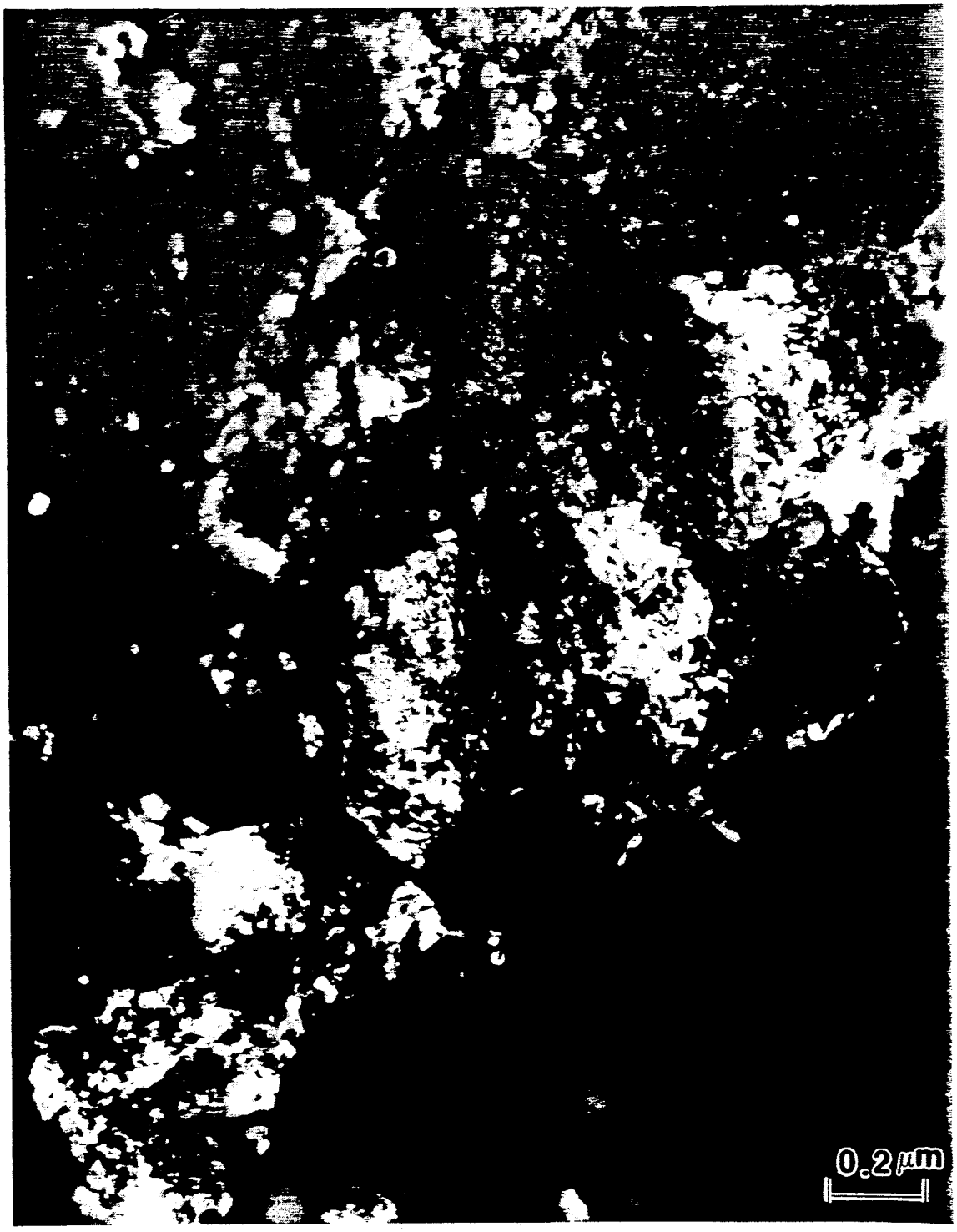
FIG. 3 is a dark field transmission electron micrograph of a sheet of $Mg_{92}Zn_2Al_5Nd_1$ rolled at 300° C., illustrating the formation of dislocation network within subgrains due to plastic deformation.
Figure 4:
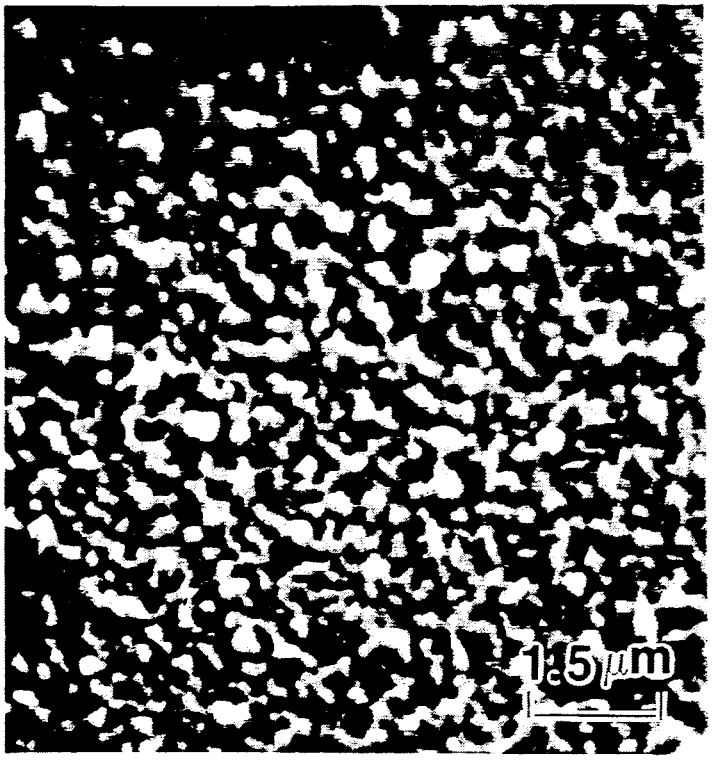
FIG. 4 is a scanning electron micrograph of sheet of $Mg_{92}Zn_2Al_5Nd_1$ rolled at 300° C., illustrating the intragranular subgrain structure as a result of dynamic recovery.
Figure 5:
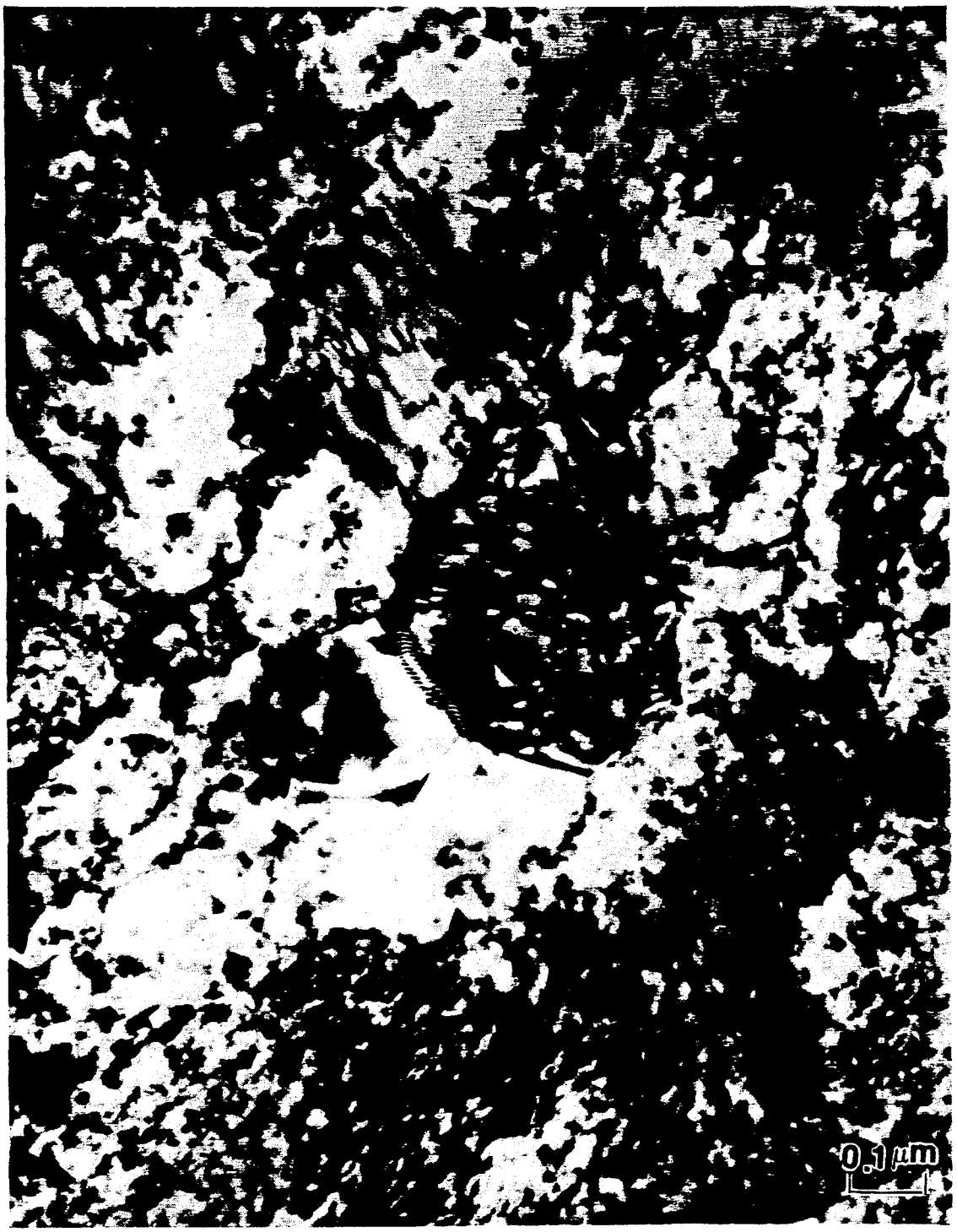
FIG. 5 is a bright field transmission electron micrograph of extrusion of $Mg_{92}Zn_2Al_5Nd_1$, illustrating the absence of dislocations.
Figure 6:
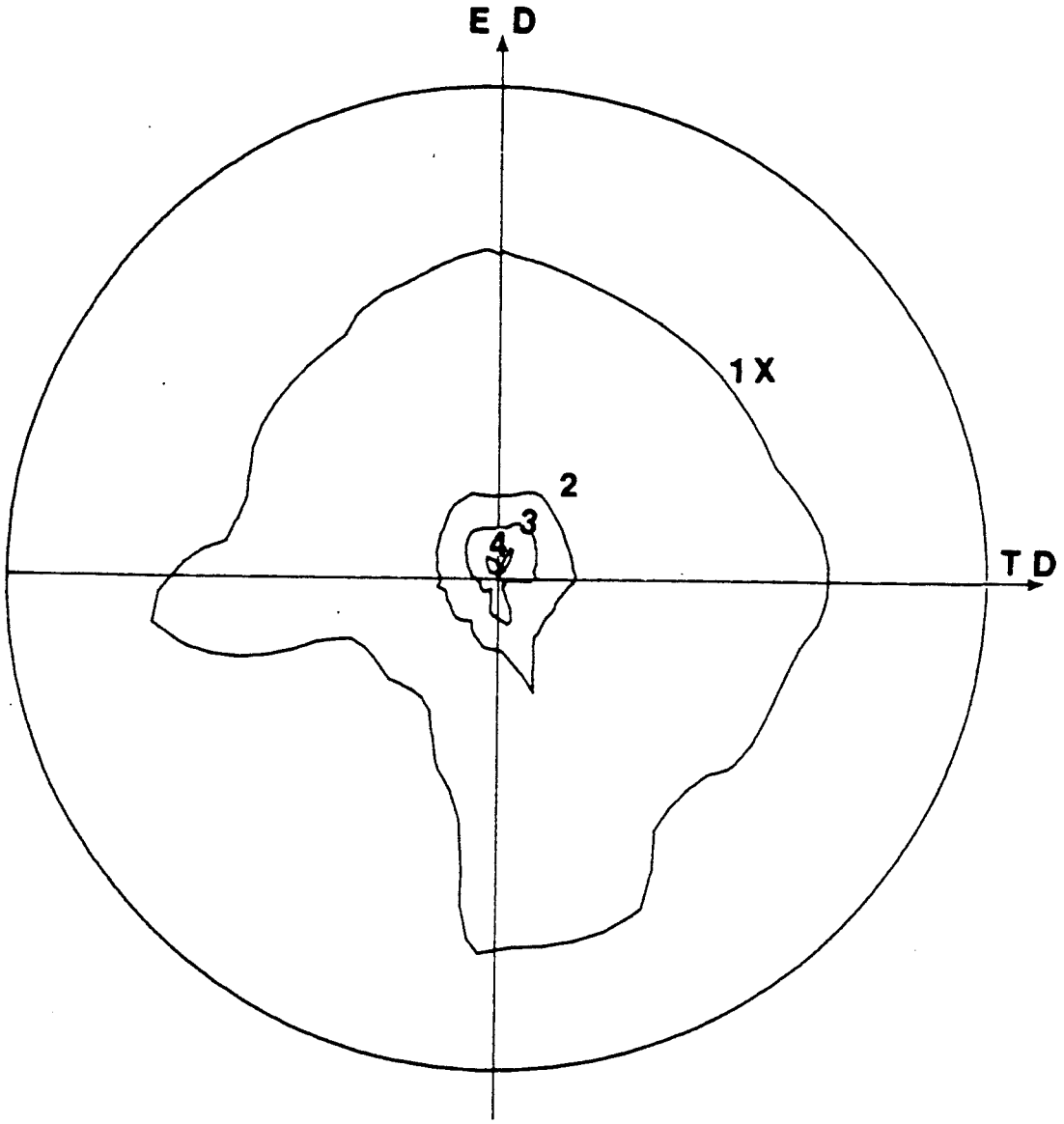
FIG. 6 is a (0001) pole figure of $Mg_{92}Zn_2Al_5Nd_1$ extrusion, illustrating a near random texture of the extrusion.

The microstructure of sheet of alloy $Mg_{92}Zn_2Al_5Nd_1$ was examined by optical micrography using conventional metallographic technique. FIG. 2*a* and FIG. 2*b* shows distorted powder particular structure in sheet, which is a result of plastic deformation at elevated temperature. The grain structure of sheet is very fine and can not be resolved by optical metallography. The sheet and extrusion were prepared for transmission electron microscopy (TEM) by ion milling. FIG. 3 shows a dark field transmission electron micrograph of sheet rolled at 300° C., illustrating the development of an intragranular subgrain structure due to dynamic recovery. In this structure, tangled and network of dislocations formed within the subgrain with the grain size of about 0.1–0.2 μm, dispersoid size of 0.02–0.04 μm. FIG. 4 is a scanning electron micrograph, also illustrating the subgrain structure. As a comparison, FIG. 5 shows a bright field transmission electron micrograph of extrusion, which has a grain size of 0.2–0.3 μm, dispersoid size of 0.01–0.04 μm, showing the absence of dislocation network. Dynamic recovery is important to soften $Mg_{92}Zn_2Al_5Nd_1$ during hot rolling due to the constraints imposed by the lack of easily activated slip systems. Dynamic recovery has been found to be a consequence of the relative difficulty of operating non-basal slip systems below 200° C. At temperatures below 200° C., basal slip, (0,0,0,1)<1,1,−2,0> is the easiest. The operation of prismatic slip, {1,0,−1,0}<1,1,−2,0> still does not provide the five independent slip systems necessary for a polycrystalline specimen to deform homogeneously.

EXAMPLE 5

The process of rolling can be described in simple terms as a compression perpendicular to the rolling plane and a tension in the rolling direction. In simple slip, the compression will rotate the active slip plane such that its normal moves toward the stress axis. Like other close-packed hexagonal metals, the most closely packed plane in magnesium is the (0001) basal plane and the close-packed directions are <1,1,−2,0>. The slip is most likely to occur on the basal plane in the <1,1,−2,0> direction.

The texture development of the sheet product [0.4 MM (0.016") thick] of alloy $Mg_{92}Zn_2Al_5Nd_1$ rolled at temperatures ranging from 200° C. to 300° C. was investigated using X-ray diffraction (XRD) with Cu Kα radiation at 40 kV and 30 mA. Table 4 shows the formation of a strong (0001) texture normal to the rolled sheet (i.e. basal plane parallel with the rolling plane) with intensity about 9 times of the intensity of the extrusion of alloy $Mg_{92}Zn_2Al_5Nd_1$ during hot rolling. As a comparison, the X-ray intensity of (0001) poles in the extrusion is about 4 times that of random sample, (FIG. 5). The formation of a strong (0001) texture in $Mg_{92}Zn_2Al_5Nd_1$ is in agreement with the rolling texture of commercial magnesium alloy. However, {1,0,−1,3} twinning instead of {1,0,−1,2} and {1,0,−1,1} twinning in $Mg_{92}Zn_2Al_5Nd_1$ is unusual. The preferred orientation resulting from plastic deformation is strongly dependent on the slip and twinning systems available for deformation, but it is not affected by processing variables such as roll diameter, roll speed, and reduction per pass. The formation of a strong unfavorable (0001) texture in $Mg_{92}Zn_2Al_5Nd_1$ raising tensile strength, and the absence of five independent slip systems causing plastic incompatibility promote brittleness. Hence, rolling of $Mg_{92}Zn_2Al_5Nd_1$ extrusion at temperatures below 200° C. results in severe cracking. These defects can be minimized by increasing the rolling temperature to 250° C. and above. Unlike commercially available magnesium alloys, $Mg_{92}Zn_2Al_5Nd_1$ can be hot rolled to the thickness of 0.4 mm without cracking. The low ductility of rolled sheet can be improved by annealing.

TABLE 4

Effect of Rolling Temperatures on the Relative X-Ray Intensities of Mg Planes of Sheet (F Temper) as Compared to Extrusion

| Planes Mg | Extrusion Front End | Extrusion Back End | Rolling Temp. 250° C. | 285° C. | 300° C. |
|---|---|---|---|---|---|
| (0, 0, 0, 2) | 0.3 | 1 | 8.2 | 6.5 | 8.9 |
| (1, 0, −1, 1) | 0.4 | 1 | 0.3 | 0.3 | 0.2 |
| (1, 0, −1, 2) | 0.5 | 1 | 0.9 | 1.2 | 0.7 |
| (1, 1, −2, 0) | 0.5 | 1 | 0.3 | 0.4 | 0.3 |
| (1, 0, −1, 3) | 0.0 | 1 | 2.4 | 2.0 | 2.7 |
| (1, 1, −2, 2) | 0.5 | 1 | 0.4 | 0.5 | 0.3 |

EXAMPLE 6

Tensile samples were machined from sheet of alloy $Mg_{92}Zn_2Al_5Nd_1$ and annealed at temperatures ranging from 325° C. to 350° C. for 2 hours and then quenched in water. Tensile properties were measured in uniaxial tension along the sheet rolling direction at a strain rate of about $5.5\times10^{-4}$/sec at room temperature. The tensile properties measured at room temperature are summarized in Table 5. At room temperature (about 20° C.), 1.9 mm (0.075") thick sheet of alloy $Mg_{92}Zn_2Al_5Nd_1$ has a yield strength of 304 MPa (44 ksi), ultimate tensile strength of 407 MPa (59 ksi) and elongation of 14% along the rolling direction; which are superior to those of commercially available rolled magnesium alloy sheet. The sheets are suitable for applications as structural components such as fins, cover, clamshell doors, tail cone, skin in helicopters, rocket and missiles, spacecraft and air frames where good corrosion resistance in combination with high strength and ductility is important.

TABLE 5

Room Temperature Properties of Annealed Rapidly Solidified $Mg_{92}Zn_2Al_5Nd_1$ Alloy Sheets

| Sample No. | Thickness (in) | Anneal Temp. (°C.) | 0.2% Y.S. ksi (MPa) | U.T.S. ksi (MPa) | El. (%) |
|---|---|---|---|---|---|
| 8 | 0.075 | 325 | 44 (304) | 59 (407) | 14 |
| 9 | 0.075 | 350 | 39 (269) | 56 (386) | 13 |
| Commercially Available Alloys | | | | | |
| ZA31B-H2 4 | | | 32 (22) | 42 (290) | 15 |
| HK31A-H2 4 | | | 30 (205) | 38 (260) | 8 |
| HM2-1A-T8 | | | 25 (170) | 34 (235) | 8 |
| M1A-H24 | | | 26 (180) | 35 (240) | 7 |

EXAMPLE 7

Superplastic tensile behavior of rapidly solidified $Mg_{92}Zn_2Al_5Nd_1$ alloy sheets were determined as a function of temperature and strain rate by characterizing (a) tensile elongation to fracture, (b) stress-strain curves at constant strain rate exhibiting the extent of strain hardening or strain softening, (c) dynamic changes in grain structure and cavitation tendencies. The tests were performed on an Instron, universal testing machine (series 4505) attached with a SATEC SF-17 three-zone furnace with independent temperature controls. Tensile tests on 2.4 mm (0.095") thick $Mg_{92}Zn_2Al_5Nd_1$ alloy sheets were performed at several selected temperatures ranging from 200° to 300° C. both in the step strain rate and the constant strain rate mode. The gage length of the specimens was 12.7 mm (0.5"). The sample was mounted on the frame of the Instron machine using Inconel 718, wedge-shaped grips. Two chromel-alumel thermocouples were placed at both ends of the gage length to monitor the temperature during the superplastic test. The furnace was preheated to the test temperature, and then wrapped around the sample. The three different zones of the furnace were manipulated to bring the sample to the test temperature and to maintain the temperature across the gage length within 1° C. during the course of the test. Both step strain rate tests and constant strain rate tests were performed on these samples.

In the step strain rate test the sample is subjected to systematic change in the strain rate and the variation in the stress is recorded as a function of strain rate. The test is repeated at different temperatures and the strain rate sensitivity is calculated as a function of strain rate as well as temperature. The objective of this experiment is to determine the optimum temperature and strain rate at which the material can be superplastically formed. There was a difference in the superplastic behavior between Batch A and B. Batch A was produced from production mill, while Batch B was produced from laboratory mill which has a better control in processing parameters. Batch B shows more superplastic. The extremely fine microstructure of this alloy allows a superplastic forming rate which is much higher than most light alloys. The condition which maximized superplastic ductility in this alloy was a temperature of 300° C. and a strain rate of 0.1/S, Table 6. An elongation of 436%, combined with uniform deformation within the gage length would allow fabrication of complex shapes. A slightly lower forming temperature of 275° C. also provides good superplastic formability of approximately 300%. The extent of cavitation in this alloy is very small and only seen near failure. No grain coarsening was observed as a result of superplastic deformation, Table 7.

TABLE 6

The effect of temperature and strain rate on the tensile elongation of rapidly solidified $Mg_{92}Zn_2Al_5Ad_1$ alloy sheets

| Temperature (°C.) | Strain Rate ($S^{-1}$) | Elongation (%) |
|---|---|---|
| 200 | 0.1 | 99.37 (AL) |
| 275 | 0.1 | 375.88 (AL) |
| 300 | 0.1 | 436.55 (AL) |
| 300 | 0.1 | 274.34 (AL) |
| 225 | 0.01 | 190.08 (AL) |
| 275 | 0.01 | 242.12 (AL) |
| 275 | 0.01 | 297.36 (BL) |
| 200 | 0.001 | 242.12 (AL) |
| 225 | 0.001 | 147.44 (AL) |
| 225 | 0.001 | 309.59 (BL) |
| 250 | 0.001 | 56.83 (AL) |
| 275 | 0.001 | 33.87 (AL) |
| 200 | 0.0001 | 269.87 (AL) |
| 225 | 0.0001 | 26.24 (AL) |
| 250 | 0.0001 | 23.74 (AL) |
| 275 | 0.0001 | 18.76 (AL) |
| 275 | 0.001 | 164.24 (BL) |
| 275 | 0.001 | 109.62 (BL) |
| 275 | 0.001 | 274.23 (BT) |

AL- Batch A, testing along longitudinal direction,
BL- Batch B, testing along longitudinal direction,
BT- Batch B, testing along longitudinal direction.

TABLE 7

The effect of temperature and strain on the grain size of rapidly solidified $Mg_{92}Zn_2Al_5Nd_1$ alloy sheets after superplastic forming

| Temperature (°C.) | Strain | Grain Intercept (μm) |
|---|---|---|
| 275 | 0 | 3.2 |

TABLE 7-continued

The effect of temperature and strain on the grain size of rapidly solidified $Mg_{92}Zn_2Al_5Nd_1$ alloy sheets after superplastic forming

| Temperature (°C.) | Strain | Grain Intercept (μm) |
|---|---|---|
| 275 | 1.73 | 2.7 |
| 275 | 2.45 | 2.7 |
| 300 | 0 | 4.1 |
| 300 | 1.00 | 3.5 |
| 300 | 1.33 | 3.2 |

To investigate the effect of overall strain and temperature on the flow stress and superplastic elongation, tensile test specimens of 2.4 mm (0.095") thick rapidly solidified $Mg_{92}Zn_2Al_5Nd_1$ alloy sheets were pulled to failure at a constant strain rate. The crosshead movement of Instron machine was programmed in a way so as to keep approximately constant strain rate during the specimen elongation. Superplastic metals are generally regarded as ideally rate sensitive; that is no strain hardening occurs during deformation. The stress-strain curves of rapidly solidified $Mg_{92}Zn_2Al_5Nd_1$ alloy sheets are typical ones for superplastic flow with a greater degree of strain hardening at the higher strain rates (~0.01/S or higher). There is often a yield point effect associated with these plots, possibly due to a significant amount of solute pinning in this alloy. At a constant strain rate, increasing the test temperature, decreases the yield strength.

TABLE 8

The stress and strain behavior of rapidly solidified $Mg_{92}Zn_2Al_5Nd_1$ alloy sheets tested at a constant strain rate

| Sample | Temperature (°C.) | Strain Rate ($S^{-1}$) | Y.S. MPa | Strain |
|---|---|---|---|---|
| AL | 275 | 0.1 | 33 | 1.6 |
| AL | 300 | 0.1 | 21 | 1.7 |
| BT | 300 | 0.1 | 25 | 1.3 |
| BL | 225 | 0.01 | 60 | 1.1 |
| AL | 275 | 0.01 | 15 | 1.2 |
| BL | 275 | 0.01 | 15 | 1.4 |
| BL | 200 | 0.001 | 38 | 1.2 |
| AL | 225 | 0.001 | 37 | 0.8 |
| BL | 225 | 0.001 | 32 | 0.8 |
| BL | 225 | 0.001 | 21 | 1.4 |
| BL | 250 | 0.001 | 26 | 0.4 |
| BL | 275 | 0.001 | 9 | 1.0 |
| AL | 275 | 0.001 | 22 | 0.3 |
| BT | 275 | 0.001 | 11 | 1.3 |
| BL | 200 | 0.0001 | 22 | 1.3 |
| AL | 225 | 0.0001 | 22 | 0.3 |
| BL | 225 | 0.0001 | 25 | 0.2 |
| BL | 250 | 0.0001 | 22 | 0.2 |
| AL | 275 | 0.0001 | 18 | 0.2 |

AL- Batch A, testing along longitudinal direction.
BL- Batch B, testing along longitudinal direction,
BT- Batch B, testing along longitudinal direction.

What is claimed:

1. Superplastically formed product produced from rolled magnesium base metal alloy sheet by a process comprising the steps of:

a. compacting a rapidly solidified magnesium based alloy powder to produce a billet, said alloy being defined by the formula $MG_{bal}Al_aAn_bX_c$, wherein X is at least one element selected from the group consisting of manganese, cerium, neodymium, praseodymium, and yttrium, "a" ranges from about 0 to 15 atom percent, "b" ranges from about 0 to 4 atom percent, "c" ranges from about 0.2 to 3 atom percent, the balance being magnesium and incidental impurities, with the proviso that the sum of aluminum and zinc present ranges from about 2 to 15 atom percent, and having a microstructure comprised of a uniform cellular network solid solution phase of a size ranging from 0.2–1.0 μm together with precipitates of magnesium and aluminum containing intermetallic phases of a size less than 0.1 μm;

b. forming said billet into a rolling stock; and c. rolling said rolling stock into sheets, said rolling step further comprising the steps of:

(i) preheating said rolling stock to a temperature ranging from 200° C. to 300° C.;

(ii) rolling said preheated rolling stock at a rate ranging from 25 to 100 rpm;

(iii) adjusting the roll gaps to produce a reduction of 2 to 25% per pass; and (iv) repeating steps (i) to (iii) at least once to produce said sheet with thickness ranging from 0.014 to 0.095" said sheet having an ultimate tensile strength of at least 400 MPa.

(d) forming said sheet into a complex shape at a strain rate ranging from $10^{-1}$ to $10^{-2}$/S, and at a temperature ranging from 275° C. to 300° C.

2. Superplastically formed product as recited in claim 1, wherein said sheet, during forming, undergoes and elongation of >300%.

3. Superplastically formed product as recited in claim 1, wherein said sheet, during forming, undergoes uniform deformation.

4. Superplastically formed product as recited in claim 1, said sheet after forming having a grain structure <5 μm.

* * * * *